United States Patent [19]

Mainetti

[11] 4,231,500

[45] Nov. 4, 1980

[54] CLOTHES HANGER

[75] Inventor: Mario Mainetti, Valdagno, Italy

[73] Assignee: S.A. Mainetti, Seclin, France

[21] Appl. No.: 14,022

[22] Filed: Feb. 22, 1979

[30] Foreign Application Priority Data

Apr. 17, 1978 [NO] Norway ..... 781330

[51] Int. Cl.[3] ..... A47J 51/142

[52] U.S. Cl. ..... 223/96; 24/132 WL

[58] Field of Search ..... 223/91, 93, 96; 24/137 R, 132 WL, 138

[56] References Cited

U.S. PATENT DOCUMENTS

| | | | |
|---|---|---|---|
| 567,537 | 9/1896 | Ernst | 24/137 R |
| 995,298 | 6/1911 | sims | 24/137 R |
| 2,617,568 | 11/1952 | Pechtel | 223/96 |
| 3,463,369 | 8/1969 | Moskowitz | 223/91 |

*Primary Examiner*—George H. Krizmanich

*Attorney, Agent, or Firm*—D. Paul Weaver

[57] ABSTRACT

A clothes hanger particularly for skirts or trousers embodies a cross member provided near its center with a suspension hook. Near opposite ends, the cross member carries two articulated clamps for gripping suspended clothes. The gripping action of each clamp, on the clothes, is developed in a gradual way by rotating a cam-shaped spreading element lodged within the upper extensions of the clamps. Simplicity and economy of manufacturing are featured.

6 Claims, 6 Drawing Figures

FIG.1
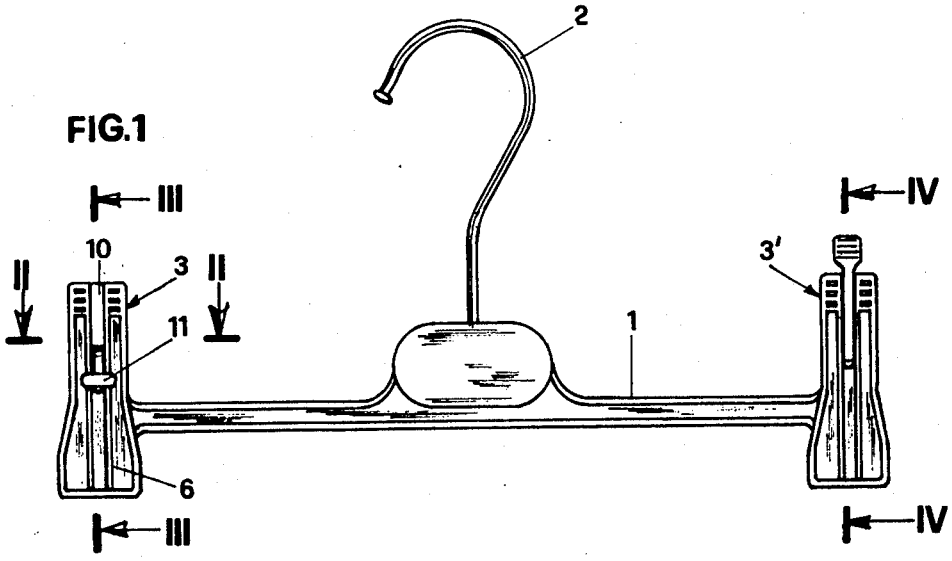
FIG.2
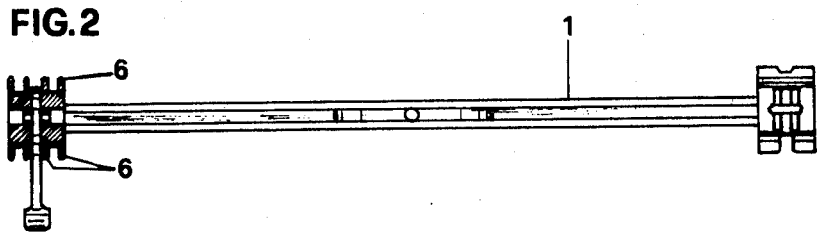
FIG.4
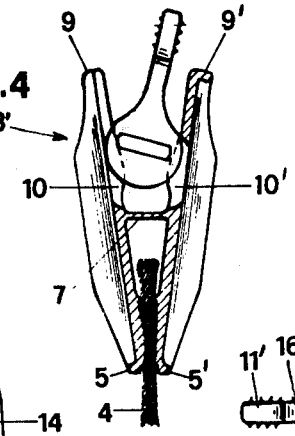
FIG.6
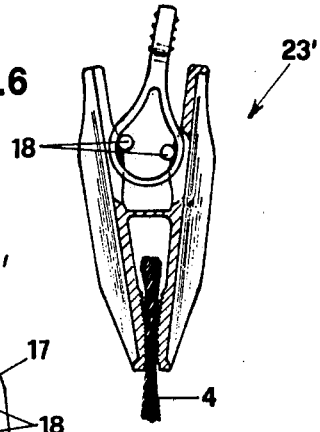
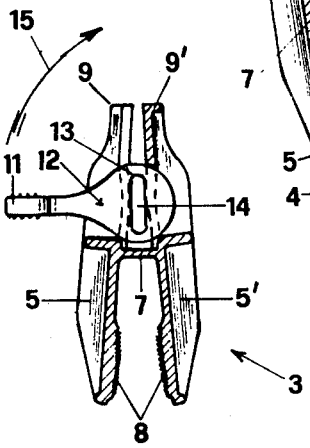
FIG.3
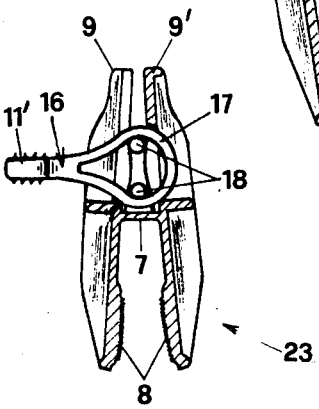
FIG.5

CLOTHES HANGER

BACKGROUND OF THE INVENTION

Various types of clothes hangers including hangers for skirts and trousers are known in the prior art. Such prior art hangers may comprise a horizontal support or cross member provided at its ends with clamps to support garments in a hanging position.

Customarily, the gripping action of the garment clamps depends on the force of springs acting on jaws of the clamps. Relatively weak springs protect the clothes from damage, but may provide insufficient clamping force to support thin layers of clothing, particularly during transport where the clothing is subjected to bumps and bounces. On the other hand, strong springs may avoid this drawback but may also damage the clothing, particularly thick layers of clothing.

Springs having adjustable forces are known in the prior art but their use in a garment hanger causes an increase in production cost far above acceptable ranges from a practical standpoint.

With the above deficiencies of the prior art in mind, the present invention seeks to provide a very simple and economical clothes hanger which can securely hold garments having a wide range of thicknesses with uniform effectiveness.

A more specific object of the invention is to provide a clothes hanger for skirts and trousers in which the adjusting of the clamps may be obtained in a very simple, direct and quick manner, at the same moment when the clothes are introduced between the claws of the clamps.

Another object of the invention is to provide a clothes hanger of very low cost and therefore likely to be widely accepted in the marketplace.

Other features and advantages of the invention will become apparent during the course of the following detailed description.

SUMMARY OF THE INVENTION

A hanger particularly for skirts and trousers is molded from plastics material and comprises a cross member having a central suspension hook.

Each opposite end of the cross member carries a clamp having opposite jaws, articulated to each other near the middle of the claw, and upper extensions, above said articulation, wherein each clamp carries a cam-shaped rotatable spreading element lodged within the upper extensions of jaws.

BRIEF DESCRIPTION OF THE DRAWINGS

FIG. 1 is a side elevation of a clothes hanger according to the invention, with the left clamp in resting position and the right clamp in an operating position.

FIG. 2 is a plan view of the same, with the left clamp sectioned on line II—II of FIG. 1.

FIG. 3 is a transverse vertical section of the left clamp of FIG. 1, taken on line III—III of FIG. 1.

FIG. 4 is a similar section of the right clamp of FIG. 1 taken on line IV—IV of FIG. 1.

FIG. 5 is a modified form of clamp, seen in a transverse vertical section, as in FIG. 3.

FIG. 6 is a modified form of clamp seen in a transverse vertical section, as in FIG. 4.

DETAILED DESCRIPTION

Referring to the drawings in detail, wherein like numerals designate like parts, the numeral 1 designates a cross member or bar forming the body portion of the garment hanger and provided at its longitudinal center with a suspension hook 2, and at its opposite ends with clamps 3, 3' to hold clothing 4, such as a skirt or trousers, suspended from the hanger.

Each clamp 3, 3' has a pair of opposed claws 5, 5' extending below the cross member 1 and strengthened by longitudinal ribs 6. The claws 5, 5' are joined near the middle of each clamp by a thin elastic plate or web 7, which forms an element of articulation between the claws and causes them to return to their position of rest shown in FIG. 3.

The portions of the claws 5, 5' below the web 7 have saw-like teeth 8 thereon, and so arranged as to hinder stripping of the clothing 4 downwardly from the clamp. Above the web 7, each clamp has jaw portions or arms 9, 9'. Within said arms 9, 9' is located a cam-shaped rotatable spreading element 12, comprising a disc portion 13, provided on its opposite sides with a cam 14 and with an operating arm 11.

A rim of the disc is lodged in a longitudinal closed slot 10' grooved out of the internal surface of the arm 9', whereas the opposite part of the disc, and the operating arm 11, are lodged in a longitudinal open slit 10, grooved in the arm 9 of the clamp.

With the sole exception of the spreading element 12, the above-described garment hanger is preferably produced in a single piece by injection molding of plastics, which minimizes manufacturing costs and sharply reduces the need for any assembling of parts.

It is also feasible to replace the molded plastics hook 2 with a metallic hook by techniques well-known in the art.

The clothes hanger according to the invention operates as follows:

In a resting position of the clamp 3, FIG. 3, the operating arm 11 of the spreading element 12 is in a practically horizontal position and protrudes from clamp 3 through the slit 10, grooved in the arm 9. In such a position, the cams 14 are vertically positioned within the gap existing between arms 9, 9', and do not come in contact with the internal surface of the arms 9, 9'. The claws 5, 5' remain in their rest position due to the memory of the elastic web 7, as seen in FIG. 3.

When an article of clothing 4 is to be suspended from the hanger, such as a pair of trousers, the trouser bottoms are inserted between the claws 5, 5' and thereafter, by a simple operation carried out with one finger, the operating arm 11 of each clamp 3, 3' is rotated in the direction of the arrow 15, FIG. 3, and brought to a substantially vertical position.

In such operating position, the ends of cams 14 exert a pressure on the internal surface of arms 9, 9', thus spreading them apart and causing the gripping action of claws 5, 5'.

The elongated shape of slot 10' allows the cams 14 to be positioned more or less distant with respect to the web 7 and therefore achieving a certain adaptation of clamps 3, 3' to the thickness of clothes 4.

Once the desired clamping effect with the clamps 3, 3' has been achieved, the latter hinder slipping out of the clothing 4 because of the arrangement of the teeth 8.

It will be appreciated that the clothes hanger according to this invention has the following advantages:

(1) An adjustable clamping action, according to the thickness of the piece of clothes 4 to be suspended.

(2) The fact that said adjustment may be achieved in a very simple and quick manner, at the same moment when it is required, i.e. directly on the piece of clothes 4 to be suspended.

(3) The fact that the clamping action of clamps 3, 3' may be adjusted independently from each other; each clamp being adjusted to the thickness of the relevant portion of the piece of clothes, thus overcoming any possible local difference in the thickness of the piece of clothes.

(4) The fact that the above-mentioned advantages may be obtained with an article of a very low cost, thus likely to reach a very wide market segment.

According to another embodiment of the invention, FIGS. 5 and 6, the spreading element 16 of the clamps 23, 23' comprises an inside hollow, plane portion 17 made of resilient or spring-like material provided with two pegs 18, perpendicularly protruding from the plane of the inside hollow portion 17, and symmetrically with respect to the plane of the operational arm 11'.

Preferably, the inside hollow portion 17 is shaped as a circular ring, elongated toward the operational arm 11'.

The spreading element 16 of clamps 23, 23' functions in substantially the same manner described above for the spreading element 12 of clamps 3, 3'. In fact, pegs 18 protruding from the plane of the inside hollow portion 17, shaped as a circular ring, engage in the internal surface of arms 9, 9' and cause the same effect as cams 14.

In this embodiment, however, the resiliency of the inside hollow portion 17 allows a closer adaptation of the clamp to the clothes 4, covering a higher range of clothing thicknesses.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A clothes hanger comprising a cross member having a central suspension hook, a pair of clamps carried by the opposite ends of the cross member and each having a pair of opposing substantially rigid claws in articulated relationship with arm extensions of the claws projecting above the points of articulation of the claws, and a pair of cam-shaped rotatable spreading elements one for each clamp lodged between said arm extensions of the clamps to thereby spread the arm extensions apart and draw said claws of the clamps together in gripping engagement on an article of clothing inserted between said claws, and each spreading element comprising an inside hollow portion formed of resilient material positioned perpendicular to the arm extensions of each clamp, an operating arm on said inside hollow portion, and two pegs eccentrically positioned on said inside hollow portion protruding perpendicularly from the plane of said portion and acting simultaneously on the internal surfaces of both arm extensions.

2. A clothes hanger as defined in claim 1, wherein one of the arm extensions of each clamp is provided with a longitudinal open slit to lodge and guide the operating arm of the spreading element, and the other arm extension is provided with a longitudinal closed slot to partially lodge the disc rim of the inside hollow portion.

3. A clothes hanger as defined in claim 2, wherein the length of the slit is greater than the length of the disc portion lodged therein.

4. A clothes hanger as defined in claim 3, wherein the inside hollow portion is formed as a ring elongated toward said operating arm.

5. A clothes hanger comprising a cross member of injected plastics material having a central suspension hook, a pair of clamps integral with the opposite ends of the cross member, each clamp having a pair of opposing substantially rigid claws held in articulated relationship by a web of the same plastics material and biasing the clamp open when the web is in a relaxed condition, said claws having arm extensions above said web, and a pair of cam-shaped rotatable spreading elements one for each clamp lodged between said arm extensions of the claws to thereby spread the arm extensions apart and draw said claws together in gripping engagement on an article of clothing inserted between said claws.

6. A clothes hanger as defined in claim 5, wherein each spreading element comprises a disc portion perpendicular to the arm extensions of each clamp, an operating arm for said disc portion, and at least a cam element attached to the disc portion and operating on the internal surfaces of both arm extensions.

* * * * *